United States Patent [19]

Schwandt et al.

[11] 4,142,480

[45] Mar. 6, 1979

[54] APPARATUS FOR DEVELOPING ELECTROPHOTOGRAPHIC COPYING MATERIALS

[75] Inventors: Rudi Schwandt; Dieter Töpfer, both of Wiesbaden, Fed. Rep. of Germany

[73] Assignee: Hoechst Aktiengesellschaft, Frankfurt am Main, Fed. Rep. of Germany

[21] Appl. No.: 840,375

[22] Filed: Oct. 7, 1977

[30] Foreign Application Priority Data

Oct. 9, 1976 [DE] Fed. Rep. of Germany ..... 2645672

[51] Int. Cl.[2] ..... G03G 13/10

[52] U.S. Cl. ..... 118/661; 118/109; 118/110; 118/647; 118/651

[58] Field of Search ..... 118/647, 651, 659, 661, 118/110, 114, 116, 109, DIG. 23

[56] References Cited

U.S. PATENT DOCUMENTS

| | | | |
|---|---|---|---|
| 677,343 | 7/1901 | Delaney | 118/114 |
| 3,039,429 | 6/1962 | Mains | 118/109 |
| 3,256,855 | 6/1966 | Oliphant | 118/DIG. 23 |
| 3,459,154 | 8/1969 | Murray | 118/109 X |
| 3,687,708 | 8/1972 | Miller | 118/661 X |
| 3,694,071 | 9/1972 | Touchette | 118/109 X |
| 3,874,328 | 4/1975 | Isonaka et al. | 118/116 |
| 3,999,511 | 12/1976 | Schwandt et al. | 118/661 |
| 4,073,266 | 2/1978 | Arneth et al. | 118/647 |

FOREIGN PATENT DOCUMENTS 2351717 4/1974 Fed. Rep. of Germany.

*Primary Examiner*—Mervin Stein

*Attorney, Agent, or Firm*—Schwartz, Jeffery, Schwaab, Mack, Blumenthal & Koch

[57] ABSTRACT

Disclosed is an apparatus for developing electrophotographic copying materials which eliminates the damage to flexible copying materials encountered with conventional developing apparatus. This apparatus comprises a pair of feed rollers for applying toner dispersion to the copying material, a guide plate for supporting the copying material within the apparatus, a distributor element for the toner dispersion which acts as a counter-electrode, means for adjustably positioning the distributor element in parallel relation above the guide plate, and a pair of squeegee rollers for removing excess toner dispersion from the copying material.

18 Claims, 6 Drawing Figures

5
6
7
8
9
10
13
14
15
19
23
25
29
30
31
32
33
34
35
36
37
38
39
45

APPARATUS FOR DEVELOPING ELECTROPHOTOGRAPHIC COPYING MATERIALS

BACKGROUND OF THE INVENTION

This invention relates to an apparatus for developing electrophotographic copying materials, the apparatus comprising a pair of feed rollers for applying a toner dispersion to the copying material, a distributor element for the toner dispersion which acts as a counter-electrode, and a pair of squeegee rollers for removing excess toner dispersion from the copying material.

It is well known that rigid metal printing plates and printing plates of flexible materials such as zinc oxide paper or plastic films may be used as copying materials. In order to achieve a uniform development of the electrostatic charge image on these printing plates, a developing apparatus has been proposed, in U.S. Pat. No. 3,999,511, in which, above the path of the copying material and between a pair of feed rollers and a pair of squeegee rollers, a distributor roller is provided which has a surface of soft, porous material and is grounded. It was found, however, that this apparatus suffered from the defect that thin white lines in relatively large black areas of the latent electrostatic charge image cannot be satisfactorily reproduced during development. In most cases, the thin white lines in the solid black areas are filled up with toner during development, which means that these lines are no longer only incompletely visible within the black area, so that the contrast effect of the toner image is poor.

In order to prevent thin white lines within black areas of an electrostatic charge image from being clogged by toner in an undesirable manner and thus increase the contrast of such thin white lines, it has been suggested, in U.S. patent application Ser. No. 658,504, now U.S. Pat. No. 4,073,266 issued Feb. 14, 1978 to use a developing apparatus in which the distributor roller for the toner has a surface of soft, porous, non-conductive material which is in contact with the copying material during its passage through the developing zone and has a metal core which is connected to the first electrode of an adjustable voltage source. The voltage applied to the distributor roller has the same sign as the surface charge on the latent electrostatic image on the copying material. In this developing apparatus, the distributor roller, which uniformly distributes the toner on the printing plate, must be lifted by the copying material, i.e. a rigid metal printing plate, as it passes through the apparatus. This provides no difficulties in the case of rigid printing plates, but is not suitable for use with thin flexible printing plates, such as zinc oxide paper or plastic film, because their stability is not sufficient to lift the distributor roller without damage to the printing plate. Moreover, breaking of the liquid developer film on the printing plate is often encountered in this apparatus during passage of the printing plate between the guide plate and the distributor roller.

SUMMARY OF THE INVENTION

Accordingly, it is an object of the present invention to provide a developing apparatus which will develop all types of electrophotographic copying materials without damage and in good quality.

It is an additional object of the instant invention to provide a developing apparatus which eliminates interruption of the liquid developer film on the printing plate.

It is a specific object of the instant invention to provide a developing apparatus which enables flexible copying materials to be developed without damage and in good quality.

Yet another object of the instant invention is to provide a developing apparatus in which the position of the distributor element may be readily adjusted to conform to the thickness of each particular copying material.

Still another object of the present invention is to provide a developing apparatus in which the distance between the copying material and the distributor element may be adjusted to provide optimum development of the copying material.

In accomplishing the foregoing and other objects, there has been provided in accordance with the instant invention a developing apparatus which comprises a housing having opposite housing walls; means for feeding the copying material into the apparatus; means for applying toner to the copying material in the housing; means including a guide surface for supporting the copying material within the housing; means for distributing the toner over the copying material; and means for adjustably positioning the distributing means within the apparatus above the guide surface. Preferably, the distributor element has a structure whereby it may function as a counter-electrode in the developing process.

Through the use of the instant apparatus, both electrophotographic copying materials of the rigid and flexible type may be developed without damage and in good quality. Moreover, by providing a distributor element whose position above the guide plate is readily adjustable, interruption of the liquid developer film on the printing plate during passage between the guide plate and the distributor element is eliminated. Furthermore, the instant apparatus enables the thickness of the liquid developer film to be adjusted to a value which results in the highest quality development of the printing plate.

Yet other objects and advantages of the present invention will become apparent to the skilled artisan upon examination of the following detailed description of the present invention, taken in conjunction with the figures of drawing, wherein:

DETAILED DESCRIPTION OF THE PREFERRED EMBODIMENTS

Figure 1B:
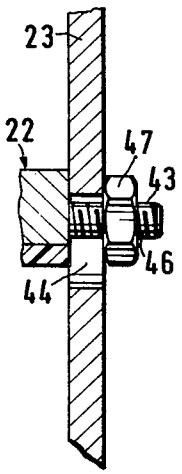
FIG. 1*b* is an enlarged view of a section along the line I—I of FIG. 1*a*.
Figure 1A:
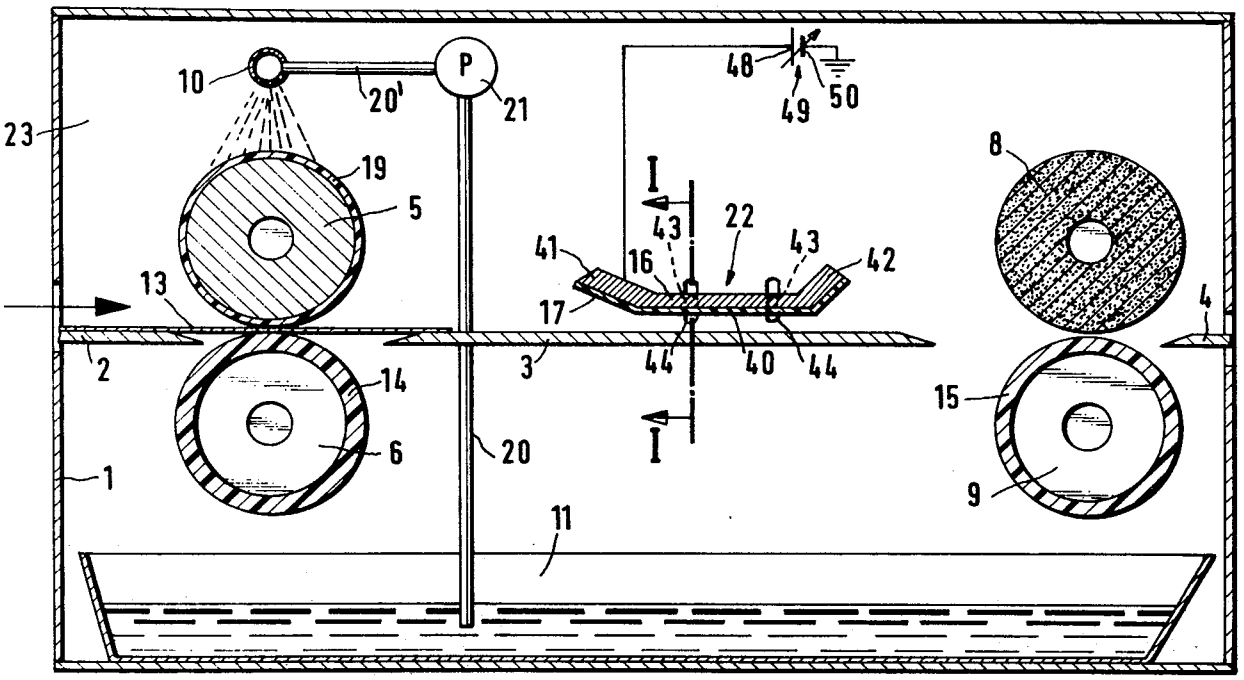
FIG. 1*a* is a schematic view, in section, of one embodiment of the invention.

Referring to FIGS. 1*a* & *b*, at the entrance to the developing zone, the developing apparatus 1 has a horizontal feed table 2 on which the copying material to be developed, e.g. an electrophotographic printing plate 13, is supported. The printing plate 13 may be of any form well known to those skilled in the art. Typically, the printing plate 13 comprises an electrically conductive support with an electrophotographic copying layer thereon, which, in a manner well known to those skilled in the art is provided with a homogeneous electrostatic charge by means of a conventional corona apparatus. Representative examples of suitable printing plates include the rigid printing plates, such as rigid metal printing plates, and the flexible printing plates such as zinc oxide paper, plastic films, etc. The printing plate 13 preferably, however, is a thin, flexible printing plate which may comprise, for example, zinc oxide paper, plastic film, or a similar material. After the electrostatic charge is applied thereon, the charged printing plate is then exposed under an original. The latent electrostatic charge image thus produced is developed in the developing apparatus 1 by means of a toner dispersion, which preferably consists of toner particles dispersed in a liquid. Feed rollers 5, 6 are arranged at the forward end and squeegee rollers 8, 9 at the rear end of the developing zone. Between these rollers and above a horizontal guide plate 3, there is arranged a slidably supported distributor element in the form of a distributor plate 22. The distributor plate 22 contains a metal core 16 and its surface 17 consists of soft, porous, non-conductive material, such as nylon, velvet or plush. The metal core 16 of the distributor plate 22 is connected to the first electrode 48 of an adjustable voltage source 49, the second electrode 50 of which is grounded. The voltage source 49 is preferably a direct current source which renders it possible to vary within wide limits the direct current applied to the metal core 16.

The distributor plate 22 comprises a first section 40 which extends parallel to the guide plate 3, and two end sections 41, 42, which are bent upwards. The two lateral surfaces of the distributor plate 22 adjoining the housing walls 23 in the longitudinal direction of the apparatus are provided with two journals 43, each of which are displaceably mounted in appropriately located oblong slots 44 in the housing walls 23. In order to be able to attach the distributor plate 22 at any desired distance from the guide plate 3, each journal 43 is provided with a thread 46 adapted to enage a lock nut 47 at the outside of the housing wall 23, so that the desired distance from the guide plate can be adjusted by appropriately displacing the distributor plate 22 in the oblong slots 44. Preferably, this distance is so adjusted that the distance between the underside of section 40 and the surface of the printing plate 13 is in the range of about 2 mm, in order to provide a thickness of the liquid film or toner dispersion of about 2 mm and to prevent an interruption in the developer film. Generally, a distance of this order must be maintained in order to prevent interruptions in the developer film and to achieve satisfactory development of the printing plate. According to the different thicknesses of the printing plates to be developed, the distributor plate 22 may be displaced in the oblong slots 44 and fixed by means of the lock nuts at the outer sides of the housing walls 23. Preferably, the oblong slots are vertically arranged, but they may also extend in an oblique direction.

The developer film is applied to the printing plate 13 by means of the upper feed roller 5. For this purpose, toner dispersion is evenly sprayed upon the roller 5 from a spray nozzle 10. Thereby, the cover 19 on the surface of the upper feed roller 5 is evenly coated from above with a liquid film which is then transferred to the printing plate 13 by rotation of the upper feed roller 5. As soon as the leading edge of the printing plate 13 reaches the distributor plate 22, the liquid film is evenly distributed by the horizontal section 40 of the distributor plate 22 over all image areas of the electrostatic charge image.

As it is further transported, the printing plate 13 is seized by the squeegee rollers 8 and 9 and conveyed to a delivery table 4. Excess toner dispersion collecting in the gap between the squeegee rollers is doctored off and drops into a collecting tray 11 extending over the entire developing zone, from the feed rollers 5, 6 to the squeegee rollers 8, 9. Between the feed rollers 5, 6 and the distributor plate 22, a suction pipe 20 is arranged, the open end of which ends in the collecting vessel 11, and suplies toner dispersion to the pump 21. A horizontal duct 20' leads from the pump 21 to the spray tube 10.

The rollers 5, 6, 8, and 9 may be manufactured of any suitable material. In the preferred embodiment, the upper squeegee roller advantageously consists of ceramic material, whereas the lower feed roller 6 and the lower squeegee roller 9 have elastic covers 14 and 15, as well as the upper feed roller 5 which is covered by an elastic cover 19.

Figure 2B:
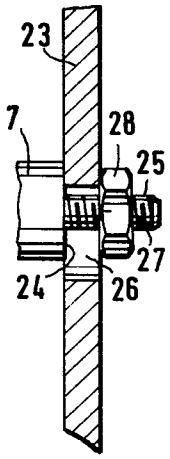
FIG. 2*b* is an enlarged view of a section along line II—II of FIG. 2*a*.
Figure 2A:
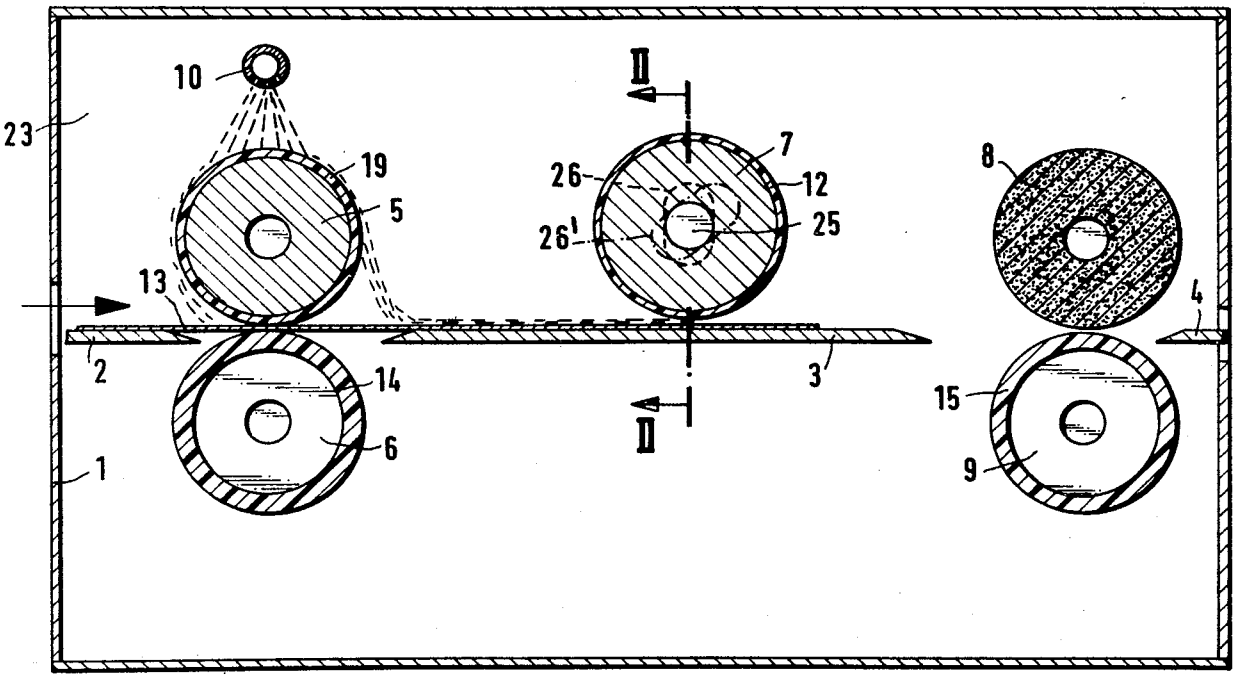
FIG. 2*a* is a sectional view showing another embodiment of the invention.

FIGS. 2*a* and 2*b* show another embodiment of the apparatus according to the invention whose structure substantially corresponds to the embodiment shown in FIGS. 1*a* and 1*b*, with the sole exception that a distributor roller 7 is provided above the guide plate 3 instead of the distributor plate 22. At each of its end planes, the axis of the distributor roller 7 terminates in a journal 25 which extends beyond the end plane of the distributor roller and is inserted in an oblong slot 26 in the adjoining housing wall 23 of the apparatus 1. The oblong slots 26 provided in opposite walls 23 of the housing extend either in the vertical direction or obliquely to the vertical direction, as indicated in the drawing by the numeral 26'. In order to secure the distributor roller 7, which may be adjustably displaced within the oblong slots 26, the journals 25 are provided with threads 27 (see FIG. 2*b*) to which lock nuts 28 are secured on the outside of the slots 26. The distributor roller 7 is positioned within the oblong slots 26 to provide an approximately 2 mm distance between the distributor roller 7 and the particular printing plate desired to be developed. When the leading edge of the printing plate 13 arrives below the distributor roller 7, which is covered by a porous cover 12, the distributor roller 7 rotates freely at a distance from and parallel to the surface of the printing plate, so that the toner dispersion is evenly distributed over all image areas of the charge image.

Figures 3A, 3B:
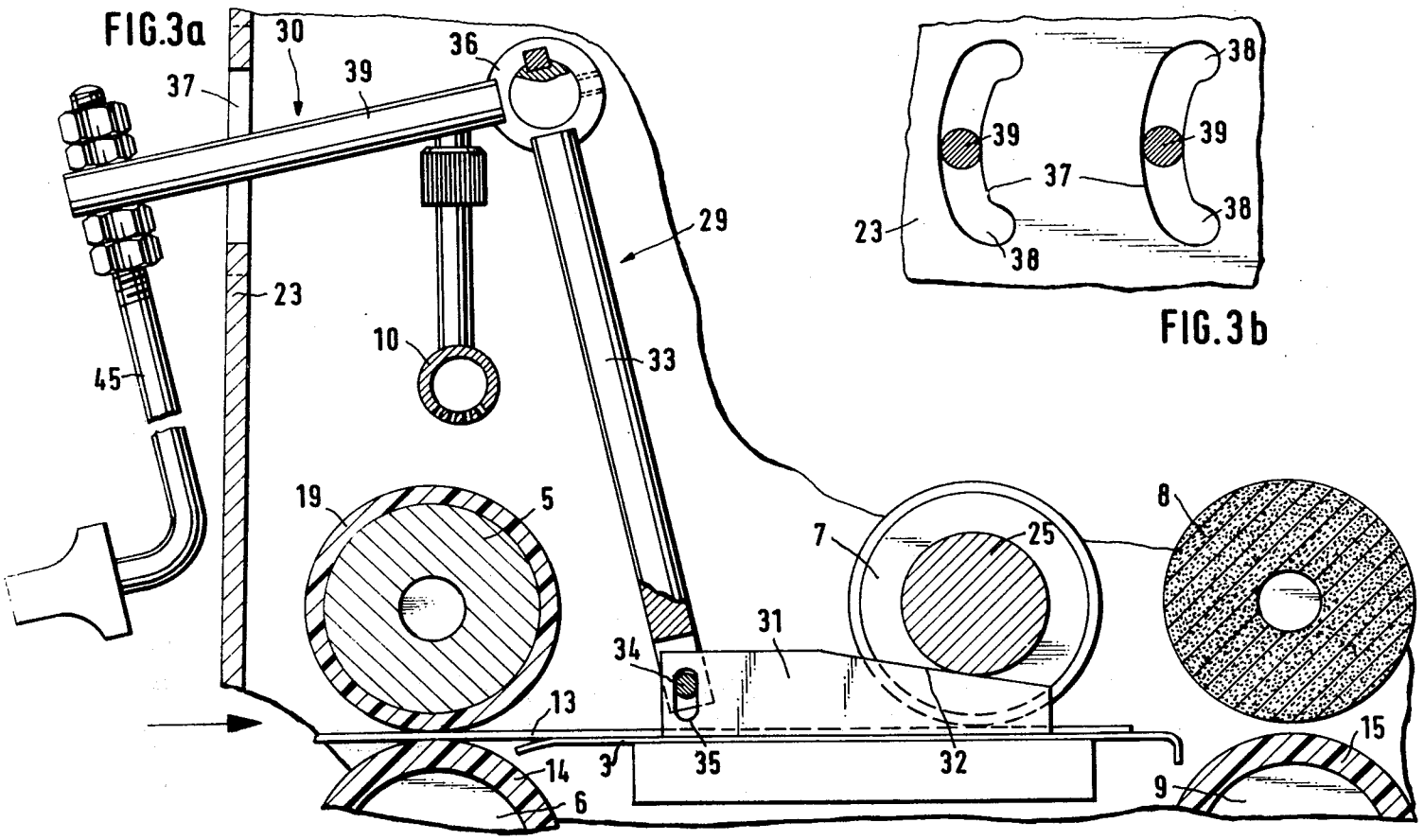
FIG. 3*a* is a schematic view, in section, through the lifting device of a further embodiment of the invention.
FIG. 3*b* is a side elevation, partially in section, of one housing wall of a developing apparatus according to the invention.

FIGS. 3*a* and 3*b* illustrate a further embodiment of the invention in which the distributor roller 7 may be displaced in the vertical direction with the aid of a lifting device 29. This lifting device 29 comprises two carriages 31 which engage the journals 25 of distributor roller 7 and a lever system 30 comprising first and second vertical levers 33 and 45, and a lever 39 which extends substantially horizontally and connects the levers 33 and 45. The lever system 30 is symmetrically constructed and comprises, on each side, the three levers 33, 39, and 45 shown in FIG. 3*a*, or at least the levers 33 and 39, with a right angle enclosed between them. If three levers are provided on each side, the two middle levers 39 are passed through slots 37 in the housing wall 23 which extends over the width of the developing apparatus, whereas the second vertical levers 45 are entirely outside of the housing of the apparatus 1.

Each of the first vertical levers 33 is connected to a carriage 31 provided with a vertical or oblong hole 35 which engages a journal at the lower end of the vertical lever 33. The vertical first lever 33 is connected to the middle lever 39 by means of a joint 36 mounted in the housing wall of the apparatus 1 in a manner not shown in the drawing. The lever system 30 may be swivelled about this joint 36 by operating the second vertical lever 45 at the outside of the housing. The slots 37 in the housing wall 23 extend parallel to each other and are of an identical arcuate shape with engaging positions 38 for the levers 39 at their ends.

Each carriage 31 is of wedge-shaped design and comprises an inclined plane 32 on which the journals 25 of the distributor roller 7 rest. When the lifting device 29 or the lever system 30 is swivelled about joint 36, the first vertical lever 33 is tilted and the journal 34 is moved in the oblong hole 35 in the carriage 31, so that the carriage is displaced in the direction of the arrow indicating the direction of feed, and the journals 25 of the distributor roller 25 are lifted by the inclined plane 32. In this manner, the distance between the surface of the distributor roller 7 and the guide plate 3 may be adjusted as required.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims.

What is claimed is:

1. An apparatus for developing an electrophotographic copying material, comprising:

(a) a housing having opposite housing walls;

(b) means for feeding a copying material into said apparatus;

(c) means for applying toner to the copying material in said housing;

(d) means including a guide surface for supporting said copying material within said housing;

(e) a distributor roller having journals extending beyond the lateral surfaces thereof for distributing the toner over said copying material; and, (f) means for adjustably mounting said distributor roller within said housing, said means comprising guide means in said opposite housing walls which receive the journals of said distributor roller, and a pair of movable wedge-shaped carriages, each of which has an inclined plane which engage and lift the journals of said distributor roller.

2. The apparatus of claim 1, wherein said distributing roller comprises a metal core and an outer surface of porous, non-conductive material.

3. The apparatus of claim 2 wherein said metal core is connected to an adjustable voltage source.

4. The apparatus of claim 3, wherein said means for feeding said copying material into said apparatus and said toner applying means comprise a pair of feed rollers.

5. The apparatus of claim 4, wherein said toner applying means further comprises a spray means for applying toner onto at least one of said feed rollers.

6. The apparatus of claim 1, further comprising means for removing excess toner for the copying material comprised of a pair of squeegee rollers and a doctor located subsequent to said toner distributor roller.

7. The apparatus of claim 1, further comprising a lever system for controlling of said carriages.

8. The apparatus of claim 7, wherein said lever system is symmetrically constructed and comprises, on each side of a plane of symmetry, at least two levers which enclose right angles between them, one of said levers being connected to one of said carriages, and another of said levers extending through the housing to the outside of the apparatus.

9. The apparatus of claim 8, wherein said lever system comprises, on each side of a plane of symmetry, a first, second, and third lever, said first and second levers enclosing a right angle between them and said first lever being connected to one of said carriages and said second lever extending through the housing to the outside of the apparatus, and said third lever being connected to said second lever.

10. The apparatus of claim 8, wherein the lever connected to said carriage has a journal which engages an oblong slot in the carriage.

11. The apparatus of claim 8, further comprising a swivel joint which is supported in a housing wall of the apparatus and about which the lever system is swivelled.

12. The apparatus of claim 8, wherein said housing has a pair of parallel slots through which said outside extending levers pass, said slots being curved and having engaging positions for said levers at their ends.

13. An apparatus for developing an electrophotographic copying material, comprising:

(a) a housing having opposite housing walls;

(b) means for feeding a copying material into said apparatus;

(c) means for applying toner to the copying material in said housing;

(d) means including a guide surface for supporting said copying material within said housing;

(e) a distributor plate having a section which extends parallel to said guide surface and an upwardly bent section on each end thereof, and having further two threaded journals on each of its lateral surfaces; and, (f) means for adjustably positioning said distributor plate within said housing, comprising a set of oblong slots in each of the opposing walls of said housing which receive the journals of said distributor plate, and a set of lock nuts which engage the threads of said journals on the outside of said oblong slots for positioning said journals within said slots.

14. The apparatus of claim 13, wherein said distributor plate comprises a metal core and an outer surface of porous, non-conductive material.

15. The apparatus of claim 14, wherein said metal core is connected to an adjustable voltage source.

16. The apparatus of claim 15, wherein said means for feeding said copying material into said apparatus and said toner applying means comprise a pair of feed rollers.

17. The apparatus of claim 16, wherein said toner applying means further comprises a spray means for applying toner onto at least one of said feed rollers.

18. The apparatus of claim 13, further comprising means for removing excess toner from the copying material comprised of a pair of squeegee rollers and a doctor located subsequent to said toner distributor plate.

* * * * *